United States Patent [19]

Tichauer et al.

[11] 4,081,270

[45] Mar. 28, 1978

[54] RENITROGENATION OF BASIC-OXYGEN STEELS DURING DECARBURIZATION

[75] Inventors: Paul Arthur Tichauer, Chappaqua, N.Y.; James Stephen Adams, Grosse Ile, Mich.; Henry Desmont Thokar, Aurora, Ohio

[73] Assignees: Union Carbide Corporation; National Steel Corporation, both of New York, N.Y.

[21] Appl. No.: 786,593

[22] Filed: Apr. 11, 1977

[51] Int. Cl.[2] ..... C21C 5/30

[52] U.S. Cl. ..... 75/60; 75/59

[58] Field of Search ..... 75/51–53, 75/59–60

[56] References Cited

U.S. PATENT DOCUMENTS

| | | | |
|---|---|---|---|
| 2,803,533 | 8/1957 | Bieniosek | 75/53 |
| 2,826,489 | 3/1958 | Wagner | 75/59 |
| 3,046,107 | 7/1962 | Nelson | 75/60 |
| 3,134,668 | 5/1964 | Pehlke | 75/60 |
| 3,180,726 | 4/1965 | Nakamura | 75/129 |
| 3,230,075 | 1/1966 | Nakamura | 75/59 |
| 3,257,197 | 6/1966 | Death | 75/59 |
| 3,402,756 | 9/1968 | Frehser | 75/59 |
| 3,649,246 | 3/1972 | Fulton | 75/59 |
| 3,725,041 | 4/1973 | Ramachandran | 75/60 |
| 3,754,894 | 8/1973 | Saccomano | 75/60 |
| 3,854,932 | 12/1974 | Bishop | 75/60 |
| 4,004,920 | 1/1977 | Fuehan | 75/60 |

OTHER PUBLICATIONS

H. A. Trenkler, "Three Years LD-Steel, Voest 1953–1956" pp. 10–16 (Vereinigre Osterreichische, 1956).

*Primary Examiner*—Peter D. Rosenberg
*Attorney, Agent, or Firm*—Warrick E. Lee, Jr.

[57] ABSTRACT

Basic-oxygen steels containing a high, controlled level of nitrogen are made by:

(a) introducing a nitrogen-rich gas into the melt during the latter portion of the decarburization step, through the oxygen lance together with the oxygen, in an amount sufficient to impart at least 100 NCF of nitrogen per ton of molten metal, and in such a manner as to promote intensive interaction of the nitrogen-rich gas with the molten metal, (b) refining the melt with the oxygen and nitrogen-rich gas by blowing the melt to a final manganese content of 0.10 percent or less, and (c) maintaining the partial pressure of nitrogen in the vessel head-space at least equal to that calculated to be in equilibrium with the aim dissolved nitrogen content of the melt at 1600° C.

9 Claims, No Drawings

RENITROGENATION OF BASIC-OXYGEN STEELS DURING DECARBURIZATION

BACKGROUND

This invention relates, in general, to refining of steel, and more particularly, to an improvement in the basic oxygen process, i.e. a process wherein molten steel contained in a vessel is refined by top blowing oxygen into the melt. More specifically, this invention is directed to a method for increasing the nitrogen content of steels made by the basic oxygen process.

The manufacture of steel by the basic oxygen process, also referred to as the BOP or BOF process, is well known in the art. When low-carbon steel is made by this process, its dissolved nitrogen content is subject to wide variations. Certain grades of steels have specifications requiring a low nitrogen content, and methods have been devised to achieve this, for example, as disclosed by Glassman's U.S. Pat. No. 3,769,000 and Pihlblad's U.S. Pat. No. 3,307,937.

On the other hand, some steels have specifications calling for high nitrogen contents, hence methods of increasing the nitrogen content have also been devised. Many of these methods require a separate nitrogen addition step after completion of the conventional decarburization step. Examples of such methods are shown in U.S. Pat. No. 2,865,736, U.S. Pat. No. 3,402,756, and U.S. Pat. Nos. 3,356,493; 3,322,530; and 3,230,075.

U.S. Pat. No. 3,180,726 discloses blowing the melt with pure nitrogen or nitrogen together with an inert gas and adding a stabilizing or fixing element after the blow. This method, however, does not allow the steel maker to adjust the nitrogen content of the steel independently, i.e. without altering the composition of the melt by adding other alloying elements. All of the above methods have the disadvantage of requiring an additional step after oxygen refining, thereby increasing the time required to make each heat of steel. Furthermore, some require the addition of other elements in order to fix the nitrogen in the melt, while others require complex teeming apparatus.

Still another approach used by the prior art has been to increase the nitrogen content of the melt during decarburization. U.S. Pat. No. 3,754,894 shows how the nitrogen content of steels may be increased during decarburization provided, however, that the decarburizing gases and nitrogen are injected from beneath the surface of the bath. This method is not easily combined with the BOF process wherein all gases are injected from above the surface of the melt. If nitrogen gas is merely blown into a basic oxygen vessel from above the bath during conventional decarburization practice, the results will not be reproducible, and the aim nitrogen content will be achieved only fortuitously.

It has not been possible, prior to the present invention, to make steels having high nitrogen contents by the basic oxygen process without performing a separate step after decarburization and/or adding elements to the melt in addition to nitrogen.

OBJECTS

Accordingly, it is an object of the present invention to make basic-oxygen steel having a nitrogen content that is reproducible and greater than that made by conventional BOP techniques.

It is another object of the present invention to make basic-oxygen steel having a high nitrogen content without requiring a nitrogen addition step after decarburization.

It is a further object of the present invention to increase the nitrogen content of basic oxygen steel without adding other alloying or stabilizing elements either together with or in addition to the nitrogen.

SUMMARY OF THE INVENTION

The above and other objects, which will readily be apparent to those skilled in the art, are achieved by the present invention, which comprises: in a process for the production of steel by decarburizing a ferrous melt contained in a vessel by blowing oxygen into the melt from above the surface thereof, the improvement comprising producing steel having a high nitrogen content, within a preselected range, by:

(a) introducing a nitrogen-rich gas into the melt, simultaneously with said oxygen during the latter portion of the decarburization step, in an amount equal to at least 100 NCF of nitrogen gas per ton of molten metal (3 $NM^3$ of nitrogen gas per metric ton) and in such a manner as to promote intensive interaction of the nitrogen-rich gas with the molten metal, (b) refining the melt with the oxygen and nitrogen-rich gas by blowing the melt to a manganese content at least as low as 0.10 percent, and (c) maintaining the partial pressure of nitrogen in the vessel head-space at least equal to and preferably higher than that calculated to be in equilibrium with the aim dissolved nitrogen content of the melt at 1600° C (2912° F).

The term "steels having a high nitrogen content" or "high-nitrogen steels" is used to mean steels having nitrogen contents of at least about 0.01 percent, or 100 ppm.

The term "aim nitrogen content" is intended to mean the final nitrogen content the steel maker is attempting to achieve.

The term "nitrogen-rich gas" as used in the present specification and claims is intended to mean a gas containing sufficient nitrogen to satisfy the equilibrium requirement of step (c), above. The preferred nitrogen-rich gases are industrially pure nitrogen or air. Gaseous nitrogen compounds that liberate sufficient nitrogen upon reacting in a BOF vessel, e.g. ammonia, may also be used.

The abbreviation "NCF" is used to mean normal cubic foot of gas measured at 70° F and 1 atmosphere pressure.

The abbreviation "$NM^3$" is used to mean normal cubic meter of gas measured at 0° C and one atmosphere pressure.

DETAILED DESCRIPTION OF THE INVENTION

When decarburizing steel by top blowing, i.e. by blowing oxygen into a melt from above the melt's surface, it is known that the nitrogen content of the melt first decreases as bubbles of CO gas formed during decarburizing sparge nitrogen from the melt. During the latter stages of decarburization by the conventional BOF process, the CO bubble generation rate decreases. This decrease is believed to have at least three important effects. First, the decrease in CO generation rate allows more atmospheric nitrogen to infiltrate the vessel because of reduced off-gas velocity at the mouth of the vessel. Second, some of this atmospheric nitrogen becomes entrained in the oxygen being blown into the melt and is ultimately absorbed. Third, the decreased CO generation also results in a decreased nitrogen sparging rate which further contributes to an increased final nitrogen level. The relationship between these factors is essentially uncontrollable, and therefore the final nitrogen content is not reproducible and tends to vary from heat to heat despite apparently identical decarburization conditions. Furthermore, the final nitrogen content of steels refined by the conventional basic oxygen process is usually lower than that required by the specifications for "high nitrogen" grades of steel. When this occurs renitrogenation is required. The following describes the preferred practice of the present invention for renitrogenation of basic-oxygen steel during decarburization.

Nitrogen-rich gas must be introduced into the melt simultaneously with the oxygen during the latter portion of the oxygen decarburization step. The preferred method of accomplishing this is by introducing the nitrogen-rich gas into the oxygen stream. This may be accomplished most simply by installing an extra connection into the oxygen line that feeds the oxygen lance, and piping a source of nitrogen-rich gas to the extra connection. Of course other, more expensive, methods may be used, as for example, a separate lance for the nitrogen-rich gas, or the use of lances having separate parallel passages for the oxygen and nitrogen-rich gas streams. Such passages may be either concentric or adjacent to each other within the same lance. An in-line mixer could also be included in the lance. However, these more complex methods offer no apparent advantage over the preferred method of practicing the invention.

The flow rate of the nitrogen gas must be sufficient to maintain a partial pressure of nitrogen in the head space above the melt that is at least equal to, and preferably greater than that which would be in equilibrium with the aim dissolved nitrogen content in the molten metal.

The amount of nitrogen-rich gas introduced must be at least equal to 100 NCF of nitrogen gas per ton of molten metal (3 $NM^3$ of nitrogen gas per metric ton) to achieve reproducible results. The amount of nitrogen absorbed by the melt increases with the amount of nitrogen introduced. However, the amount of nitrogen absorbed will vary from BOP system to BOP system. Once the relationship between amount of nitrogen introduced and final nitrogen content is experimentally determined for a particular BOF system, and provided other variables are held constant, reproducible results can consistently be attained by practice of the present invention, as long as the prescribed minimum amount of nitrogen is injected into the melt.

The oxygen and nitrogen-rich gas mixture must be blown in to the melt in a manner that promotes intensive interaction between the nitrogen-rich gas and the bath. If this is not implemented, then consistent results will not be obtained.

One means of accomplishing the intensive interaction is to employ lance pressures significantly greater than those normally used. Each BOP system has a normal oxygen blowing pressure used during conventinal decarburization. It is believed that the normal oxygen lance blowing pressure in most BOF shops is insufficient to accomplish the interaction necessary to practice this invention. Substantially increasing the lance pressure during nitrogen-rich gas addition will accomplish the desired result. For example, it was found that in a 235 ton (213 metric ton) BOF vessel equipped with a lance having four 1.75 inch (4.45 cm) diameter ports, an increase in lance pressure from about 115 psig (8.1 $kg/cm^2$ gage) to about 150 psig (10.6 $kg/cm^2$), i.e. about a 30 percent increase in gage pressure, was sufficient to generate the requisite interaction of the gas with the melt. Note, however, that penetration of the gas jet and the resultant stirring action is not completely predictable from vessel to vessel and can only be empirically determined. The blowing pressures used in some BOF shops may not require an increase in order to achieve the gas-melt interaction required by the present invention.

Another method of obtaining the required intensive interaction is to blow the mixture of nitrogen-rich gas and oxygen with the lance in lower position than normal. As with lance pressure, all BOP shops have normal lance positions for various stages of conventional oxygen decarburization. Typically the lance is gradually lowered as decarburization proceeds. Conventional lance positions may not produce sufficient interaction of the gas with the melt to reproducibly renitrogenate the melt. This problem can be corrected by moving the lance to a lower position than normal during the latter stages of decarburization, while introducing the nitrogen-rich gas.

Still another method of accomplishing the requisite gas-melt interaction is to inject the nitrogen-rich gases with nozzle velocities that are higher than normally used in conventional BOF practice. Hence, in order to practice the present invention, some BOF shops may have to increase their lance gas velocities by using lances with smaller diameter gas discharge nozzles.

Another requirement for obtaining reproducible results is that the manganese content of the melt be blown to less than 0.10 percent during decarburization. The manganese is merely an "indicator" reflecting the conditions within the melt necessary for reproducibility of nitrogen pick-up, and is not intended to infer a causal relationship between manganese in the steel and nitrogen absorption. In normal BOP practice, the manganese level is adjusted to final specification subsequent to the decarburization with the addition of various ferromanganese alloys. Hence, the process is only minimally affected by consistently blowing to less than 0.10 percent manganese during decarburization.

The following examples illustrate the preferred practice of the invention.

EXAMPLES

Six 235 ton (213 metric ton) heats were refined by top blowing with pure $O_2$ in a BOP refining system in accordance with standard BOP operating practices. Table I below shows the values of the variables that were experimentally manipulated and the results obtained. In each case, industrially pure nitrogen was introduced admixed with oxygen via the oxygen lance, beginning "*t*" minutes before the estimated completion of the decarburization step. The value of "*t*" varied from heat to heat as shown in the Tables I and II below.

TABLE I

| Heat No. | 1 | 2 | 3 |
|---|---|---|---|
| Oxygen Blow rate, NCFM ($NM^3$/min) | 20,000 (530) | 18,000 (470) | 20,000 (530) |
| Nitrogen Blow rate, NCFM ($NM^3$/min) | 3,400 (90) | 5,600 (150) | 3,000 (80) |

TABLE I-continued

| Heat No. | 1 | 2 | 3 |
|---|---|---|---|
| t, approximate duration of $N_2$ Blow, minutes | 7 ½ | 7 ¼ | 10 |
| Amount of $N_2$ per ton, NCF/ton ($NM^3$/metric ton) | 109 (3.2) | 173 (5.0) | 128 (3.7) |
| Lance pressure during $N_2$ Blow, psig ($Kg/cm^2$) | 150 (10.6) | 152 (10.7) | 155 (10.9) |
| Melt Temperature at Turndown ° F (° C) | 2,975 (1635) | 2,840 (1560) | 2,950 (1621) |
| Melt Analysis at Turndown, (%) | | | |
| C | 0.03 | 0.03 | 0.03 |
| Mn | 0.08 | 0.07 | 0.08 |
| FeO (in slag) | 36.18 | 33.90 | 30.82 |
| N | 0.0153 | 0.017 | 0.0161 |
| Aim Nitrogen Content,(%) | 0.014 | 0.016 | 0.016 |
| Nitrogen Specification Range, (%) | 0.012–0.016 | 0.014–0.018 | 0.014–0.018 |

The first three heats shown in Table I, illustrate the correct practice of this invention, adhering to all its requirements, the main requirements being that:

(1) The requisite mixing intensity be obtained, here by employing a lance pressure higher than normal during the nitrogen introduction. The normal lance pressure for the vessel is approximately 115 psig (8.1 $kg/cm^2$), (2) At least 100 NCF (3 $NM^3$) of nitrogen be introduced per ton (metric ton) of steel, and (3) The manganese content be blown to 0.10% or less.

It is to be noted that for each of these three heats, the final nitrogen content was easily within 10% of the aim nitrogen content, and all were within the range of acceptable nitrogen specification for the intended grade. This kind of reproducibility has not been possible prior to the present invention.

TABLE II

| Heat No. | 4 | 5 | 6 |
|---|---|---|---|
| Oxygen Flow Rate, NCFM $NM^3$/min) | 20,000 (530) | 14,000 (370) | 20,000 (530) |
| Nitrogen Blow Rate, NCFM ($NM^3$/min) | 5,600 (150) | 5,000 (130) | 4,000 (110) |
| t, approximate duration of $N_2$ Blow, minutes | 4 ½ | 5 | 4 ½ |
| Amount of $N_2$ per ton, NCF/ton ($NM^3$/metric ton) | 109 (3.2) | 105 (3.1) | 78 (2.3) |
| Lance pressure during $N_2$ Blow, psig ($kg/cm^2$) | 165 (11.6) | 118 (8.3) | 150 (10.6) |
| Melt Temperature at Turndown, ° F (° C) | 3,020 (1660) | 2,895 (1591) | 2,880 (1582) |
| Melt Analysis at Turndown, (%) | | | |
| C | 0.03 | 0.05 | 0.03 |
| Mn | 0.12 | 0.09 | 0.09 |
| FeO (in slag) | 24.12 | n.a. | n.a. |
| N | 0.0105 | 0.0110 | 0.0111 |
| Aim Nitrogen content, (%) | 0.014 | 0.016 | 0.014 |
| Nitrogen Specification Range, (%) | 0.012–0.016 | 0.014–0.018 | 0.012–0.016 |

Heats 4, 5, and 6, shown in Table II, illustrate the unsatisfactory results obtained when one of the three requirements of the invention is not followed. The turndown nitrogen contents of Heats 4, 5, and 6 fall significantly short of the aim, i.e. by 40 to 50 percent, and lay outside of the acceptable nitrogen specifications for the intended grades. Heat 4 and proper gas-melt interaction, obtained by increased lance pressure and the proper amount of nitrogen, but the manganese content was not blown below 0.10%. For Heat 5, all requirements of the invention were fulfilled, except that the low lance pressure employed produced insufficient interaction between the melt and the nitrogen. An insufficient amount of nitrogen was the only requirement violated in Heat 6.

What is claimed is:

1. In a process for the production of steel by decarburizing a ferrous melt contained in a vessel by blowing oxygen into the melt from above the surface thereof, the improvement comprising:

producing steel having a high nitrogen content, within a preselected range by:

(a) introducing a nitrogen-rich gas into the melt, simultaneously with said oxygen during the latter portion of the decarburization step, in an amount at least equal to 100 NCF of nitrogen gas per ton of molten metal, and in such manner as to promote intensive interaction of the nitrogen-rich gas with the molten metal, (b) refining the melt with the oxygen and nitrogen-rich gas by blowing the melt to a final manganese content at least as low as 0.10 percent, and (c) maintaining the partial pressure of nitrogen in the vessel head-space at least equal to that calculated to be in equilibrium with the aim dissolved nitrogen content of the molten metal at 1600° C.

2. The process of claim 1 wherein the nitrogen-rich gas is introduced through the oxygen lance.

3. The process of claim 2 wherein the nitrogen-rich gas is introduced together with the oxygen gas.

4. The process of claim 1 wherein the nitrogen-rich gas is nitrogen.

5. The process of claim 1 wherein the nitrogen-rich gas is air.

6. The process of claim 3 wherein intensive interaction between the nitrogen-rich gas and the molten metal is obtained by blowing the mixture of nitrogen-rich gas and oxygen at a lance pressure substantially higher than normal oxygen lance blowing pressure.

7. The process of claim 6 wherein the mixture of nitrogen-rich gas and oxygen is blown at a lance pressure at least 30 percent higher than normal oxygen lance blowing pressure.

8. The process of claim 3 wherein intensive interaction between the nitrogen-rich gas and the molten metal is obtained by blowing the mixture of nitrogen-rich gas and oxygen at a lance nozzle velocity that is substantially higher than normal oxygen lance nozzle velocity.

9. The process of claim 3 wherein intensive interaction between the nitrogen-rich gas and the molten metal is achieved by blowing the mixture of nitrogen-rich gas and oxygen with the lance in a lower position than the normal oxygen lance position.

* * * * *